US005558383A

United States Patent [19]

Lancellotti

[11] Patent Number: 5,558,383

[45] Date of Patent: Sep. 24, 1996

[54] CARRYING DEVICE

[76] Inventor: William E. Lancellotti, 10 Brookwood Dr., Johnston, R.I. 02919

[21] Appl. No.: 595,418

[22] Filed: Feb. 5, 1996

Related U.S. Application Data

[62] Division of Ser. No. 415,736, Apr. 3, 1995, abandoned.

[51] Int. Cl.[6] ..... A47G 25/06

[52] U.S. Cl. ..... 294/143; 294/159

[58] Field of Search ..... 294/137, 141–143, 294/153, 158, 159, 162, 163, 166, 170, 171; 223/85, 88, DIG. 4; 224/217, 218, 251, 313, 927

[56] References Cited

U.S. PATENT DOCUMENTS

| | | | |
|---|---|---|---|
| 3,313,460 | 4/1967 | Hooker | 294/159 |
| 3,578,226 | 5/1971 | Good | 294/137 |
| 3,633,801 | 1/1972 | Bonasso | 294/142 |
| 3,961,734 | 6/1976 | Threeton | 294/143 |
| 4,153,189 | 5/1979 | Hughes | 294/143 |
| 4,466,652 | 8/1984 | Townsend | 294/142 |
| 4,754,858 | 7/1988 | Robinson | 294/137 X |
| 4,856,688 | 8/1989 | Ackmann | 294/142 X |
| 5,330,244 | 7/1994 | Rodwell | 294/143 |

FOREIGN PATENT DOCUMENTS

| | | | |
|---|---|---|---|
| 467121 | 6/1914 | France | 294/170 |
| 1866/92 | 3/1937 | Switzerland | 294/170 |

*Primary Examiner*—Johnny D. Cherry
*Attorney, Agent, or Firm*—Salter & Michaelson

[57] ABSTRACT

A carrying device for carrying articles on hangers or bags with handles. The carrying device includes a top attaching element which is releasably attached to a hook, such as an automobile clothes hook on an interior wall of an automobile, a bottom support element which supports articles, such as a clothes hanger, and a pair of oppositely extending carrying portions which are disposed between the top attaching and bottom support elements and are grasped between two fingers of a person's hand for carrying the device. The bottom support element is disposed along a plane generally transverse to the plane of the top attaching element so that when a hanger is hung on the device and the device is attached to the hook, it lies along a plane generally parallel to the plane of the interior wall of the automobile. The top attaching element, carrying portions and bottom support element are integrally formed as one unit and rigid with respect to one another for easily attaching the device to the automobile clothes hook.

5 Claims, 4 Drawing Sheets

CARRYING DEVICE

This is a division of application Ser. No. 08/415,736 filed Apr. 3, 1995, now abandoned.

BACKGROUND AND SUMMARY OF THE INVENTION

This invention relates generally to carriers, and more particularly to a carrying device for carrying a plurality of hangers having clothes hung thereon or for carrying bags with handles.

Various devices have been developed for carrying clothes hangers and for supporting the hangers on an automobile clothes hook which is typically located above the passenger or rear passenger door in an automobile. Two such devices are disclosed in U.S. Pat. Nos. 3,313,416 (Hooker) and 5,330,244 (Rodwell). A disadvantage associated with both of these devices is that each is constructed with a support hook or ring which swivels with respect to the portion of the device which carries the clothes hangers, thereby making it difficult to hang the device on the automobile clothes hook. It appears that with each device, a person must carefully manipulate it for ensuring that the support hook is oriented properly when attaching it to the automobile clothes hook. The carrying device of the present invention is adapted to overcome this disadvantage.

Accordingly, among the several objects of the present invention are the provision of an improved carrying device capable of carrying clothes hangers which is easily hung on an automobile clothes hook; the provision of such a carrying device which is comfortable to carry; the provision of such a carrying device which is also capable of carrying bags with handles; and the provision of such a carrying device which is simple in construction, easy to manufacture and easy to use.

In general, the present invention is directed to a carrying device for carrying articles on hangers or bags with handles. The carrying device comprises a top attaching element constructed and arranged for being releasably attached to a hook, such as an automobile clothes hook fixedly attached to an interior wall of the automobile, a bottom support element constructed and arranged for supporting articles, such as hangers or bags with handles, and carrying means disposed between the top attaching and bottom support elements. The bottom support element is disposed along a plane generally transverse to the plane of the top attaching element so that when a hanger is hung on the device and the device is attached to the hook, it lies along a plane generally parallel to the plane of the interior wall of the automobile. In a preferred embodiment, the carrying means comprises a pair of oppositely extending carrying portions adapted to be grasped between two fingers of a person's hand. The top attaching element, carrying means and bottom support element are integrally formed as one piece and rigid with respect to one another for easy attachment with one hand to the automobile hook.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENTS

Figure 1:
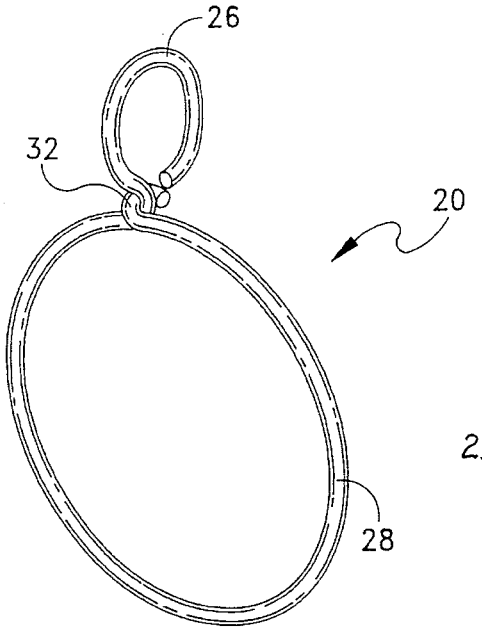
FIG. 1 is a front perspective view of a carrying device of the present invention.
Figure 2:
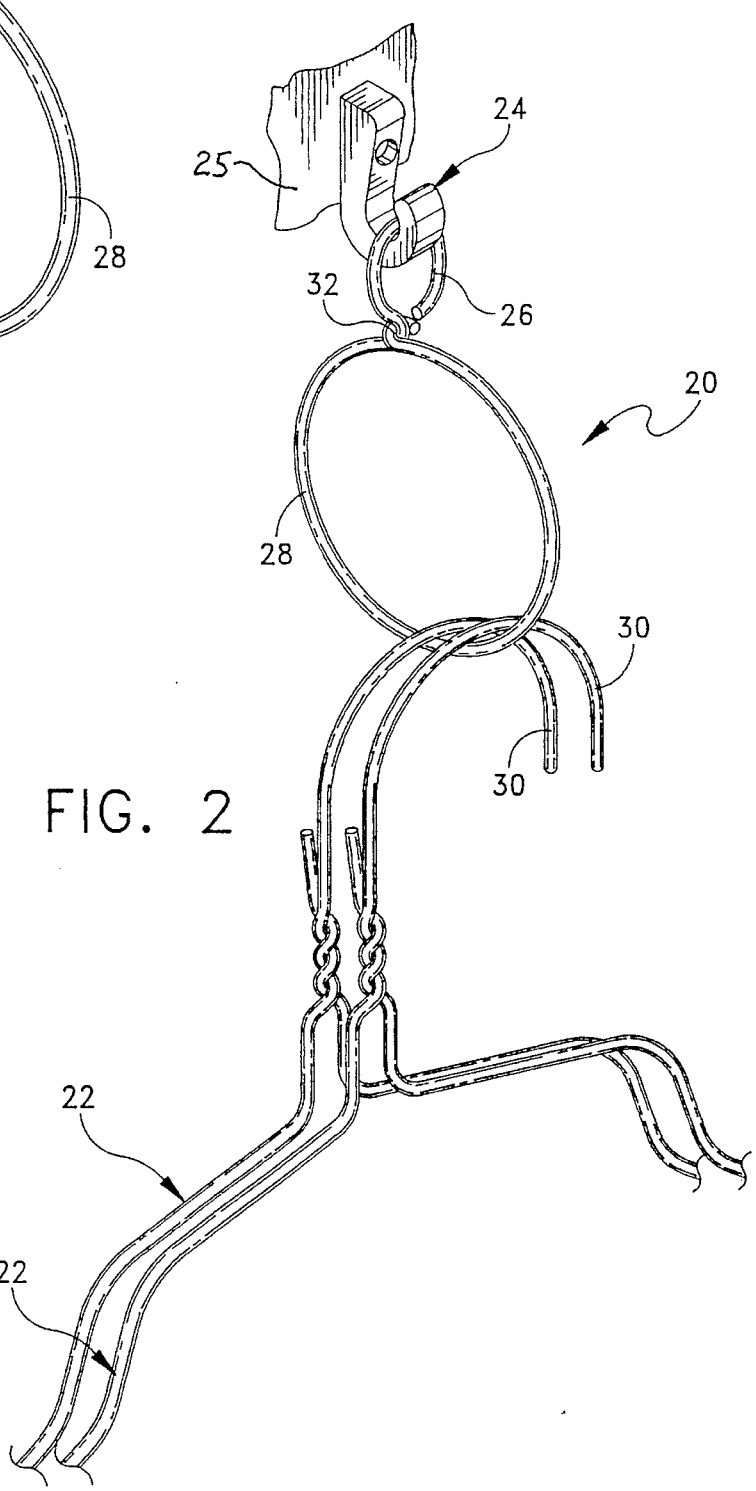
FIG. 2 is a front perspective view of the carrying device supporting a plurality of hangers on an automobile clothes hook.

Referring now to the drawings, and more particularly to FIGS. 1 and 2, there is generally indicated at 20 a carrying device of the present invention illustrating one of several preferred embodiments. As illustrated in FIG. 2, device 20 is especially designed for supporting wire clothes hangers, each generally indicated at 22, on an automobile clothes hook, generally indicated at 24 which is mounted on an interior wall 25 of an automobile.

More particularly, the carrying device 20 comprises a top attaching element 26 shaped in the form of a ring which is slipped over the automobile clothes hook 24 and a bottom support element 28 which is also shaped in the form of a ring, although these elements 26, 28 can embody any number of different closed loop shapes, such as trapezoids, rectangles, squares, etc., and still fall within the scope of the present invention. Hook portions 30 of hangers 22 are hung on the bottom support element 28 of the carrying device 20 for supporting the hangers 22.

As illustrated, the bottom support element 28 is disposed along a plane generally transverse to the plane of the top attaching element 26 so that when hangers 22 are hung on the bottom support element 28 and the device is hung on hook 24, they lie in a plane generally parallel to the plane of the interior wall 25. In the embodiment illustrated in FIGS. 1 and 2, the carrying device 20 is fabricated from wire which is shaped and twisted to form the top attaching element 26 and bottom support element 28. It should also be understood that the carrying device 20 of the present invention could also be made of other materials, such as molded plastic, which will be disclosed in greater detail for other embodiments of the present invention described below. The top attaching element 26 is formed by shaping a circular loop with the wire and then twisting the wire at 32. The bottom support element 28 is then formed by shaping a circular loop and bending the end of the wire so that it resiliently engages the wire adjacent twist 32. It should be noted that since the top attaching element 26 is integrally rigidly formed with respect to the bottom support element 28, there is no risk that the bottom support element 28 will move relative to the top attaching element 26. Thus, this construction enables a person to releasably attach the top attaching element 28 to the automobile clothes hook 24 with one hand while holding the bottom support element 28.

Figure 3:
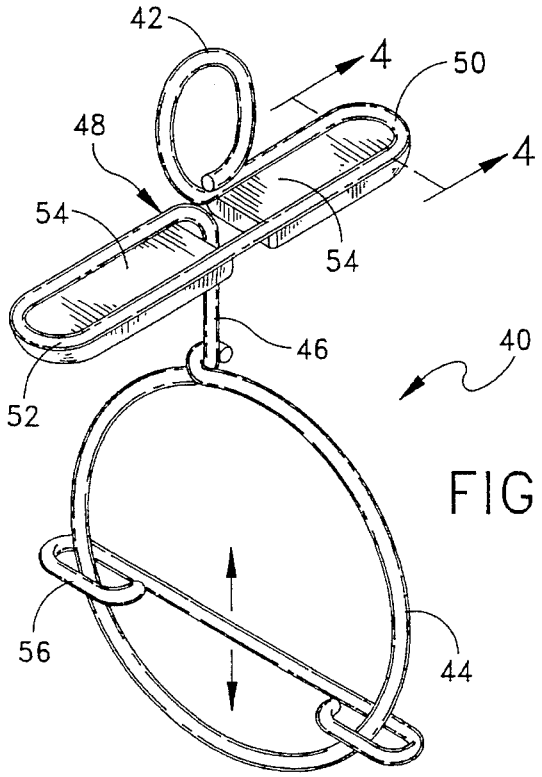
FIG. 3 is a front perspective view of a carrying device of another preferred embodiment.
Figure 4:
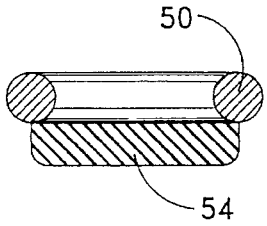
FIG. 4 is an enlarged cross-sectional view taken along line 4—4 of FIG. 3.
Figure 5:
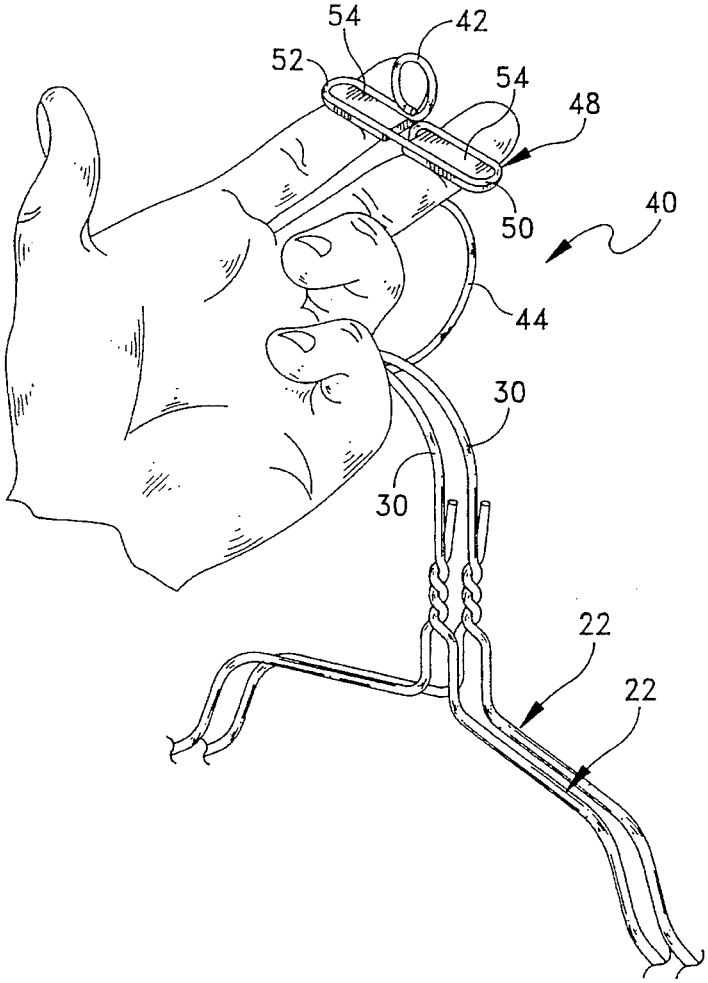
FIG. 5 is a front perspective view of the carrying device illustrated in FIG. 3, the carrying device supporting a plurality of hangers and being carried by a person's hand.

Turning now to FIGS. 3–5, there is illustrated a carrying device generally indicated at 40 of another preferred embodiment. Carrying device 40 comprises a top attaching element 42 and a bottom support element 44 embodied in the same form as the top attaching and bottom support elements 26, 28 of carrying device 20. A connector member 46 fixedly attaches the top attaching element 42 to the bottom support element 44. Additionally, the carrying device also comprises carrying means, generally indicated at 48, disposed between the top attaching element 42 and bottom support element 44. As shown in FIG. 5, carrying means 48 comprises a pair of oppositely extending carrying portions 50, 52 which are constructed and arranged for being grasped between two fingers of a person's hand, e.g., the middle finger and index finger.

In the illustrated embodiment, the carrying device 40 is also integrally formed as one-piece and fabricated from wire which is shaped and twisted to form the top attaching element 42, bottom support element 44 and carrying portions 50, 52. The shaping of carrying device 40 is substantially similar to the shaping of carrying device 20 except for the formation of carrying portions 50, 52 which are formed by elongate loops of wire. This construction results in each individual component of the carrying device, including the carrying portions 50, 52 and bottom support element 44 being fixed and rigid with respect to the other components. It should be noted that since these components of the carrying device 40 are integrally formed, the person attaching it to the automobile hook 24 is able to use one hand as with device 20.

Carrying device 40 further includes, for each carrying portion 50, 52, a pad 54 mounted on the underside of the carrying portion. The pads 54 are positioned on their respective carrying portions 50, 52 to engage the person's fingers when carrying the device 40 for cushioning purposes. The pads 54 may be attached to the carrying portions 50, 52 in any suitable manner, such as by adhesive. Alternatively, the carrying portions 50, 52 may receive rubber sleeves (not shown) for cushioning them. Since wire has a tendency to cause unwanted pressure on a person's fingers, especially when carrying heavy loads, such as a number of articles of clothing on hangers, the pads 54 not only cushion the person's fingers but also spread the load over the surface areas of the pads.

Carrying device 40 also includes a locking bar 56 which is slidably mounted on the bottom support element 44 for locking clothes hangers 22 to the support element 44 when carrying them. As shown, the locking bar 56 includes closed loop end portions which receive the bottom support element therethrough for enabling the locking bar to slide in the manner illustrated by the arrows in FIG. 3.

Figure 6:
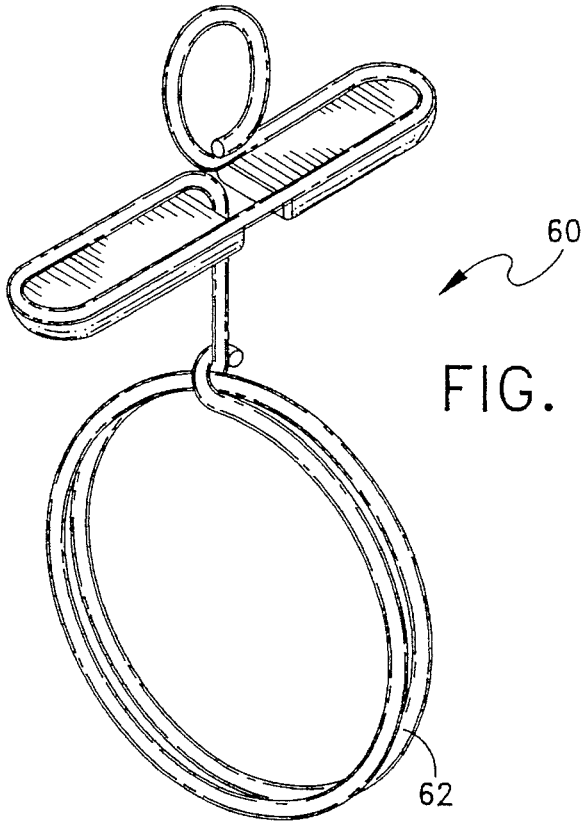
FIG. 6 is a front perspective view of a carrying device of another embodiment similar to the embodiment illustrated in FIGS. 3–5.
Figure 7:
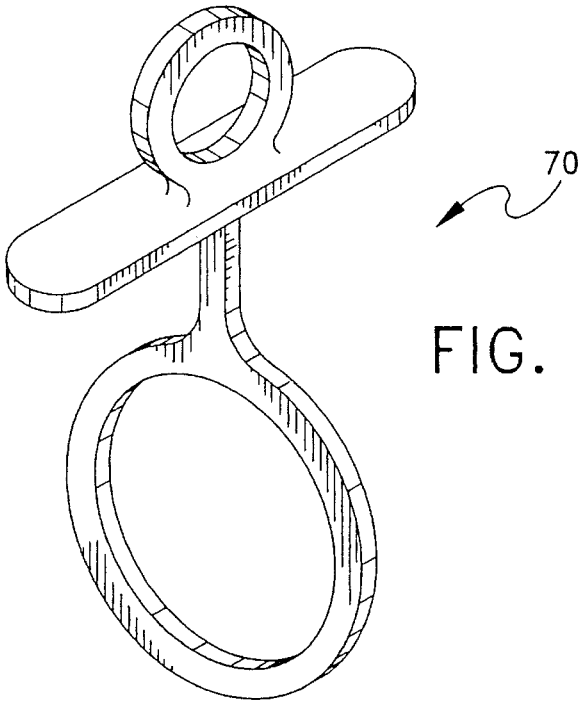
FIG. 7 is a front perspective view of a carrying device of another embodiment similar to the embodiments illustrated in FIGS. 3–6.

FIGS. 6 and 7 illustrate modifications of the embodiment illustrated in FIGS. 3–5. Namely, FIG. 6 shows a carrying device generally indicated at 60 nearly identical to the carrying device of FIGS. 3–5 except for the provision of two loops which form its bottom support element 62. Two loops are provided for increasing the strength of the bottom support element 62. Turning to the embodiment illustrated in FIG. 7, a carrying device 70 formed of molded plastic is shown, the device having a neat, clean appearance.

Figure 8:
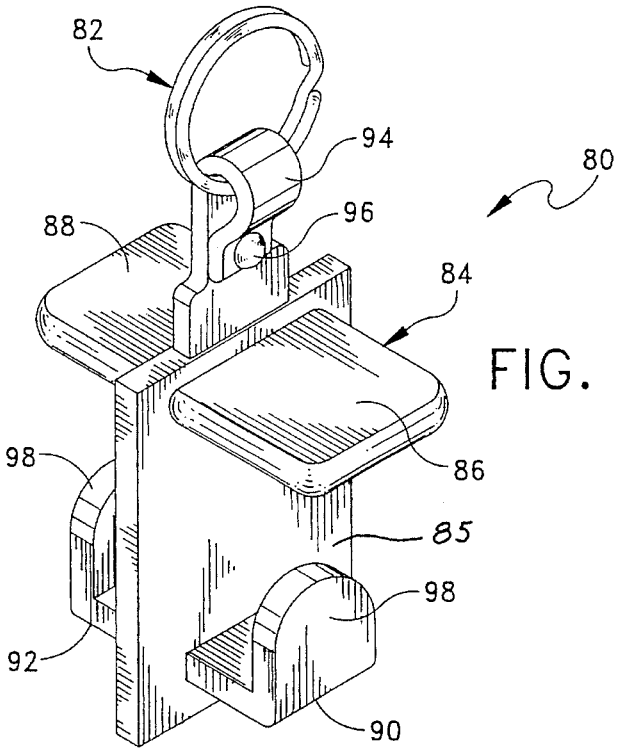
FIG. 8 is a front perspective view of a carrying device of yet another embodiment.
Figure 9:
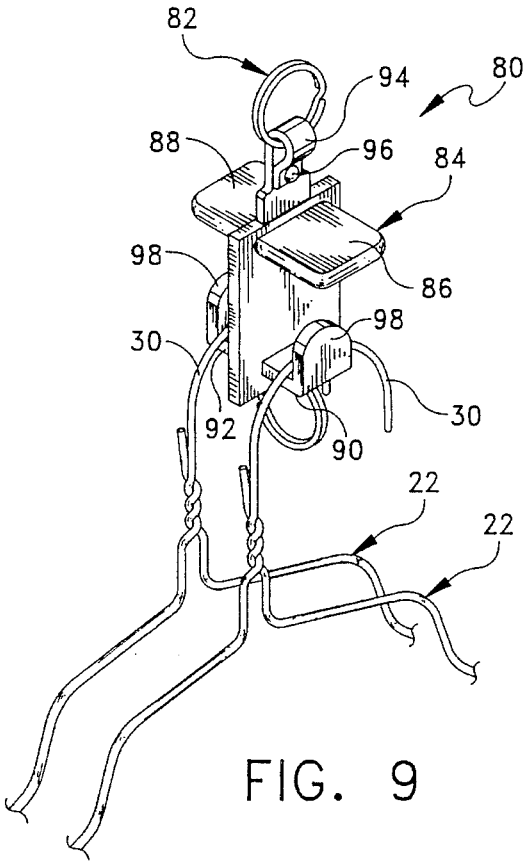
FIG. 9 is a front perspective view of the carrying device illustrated in FIG. 8, the carrying device supporting a plurality of hangers.
Figure 10:
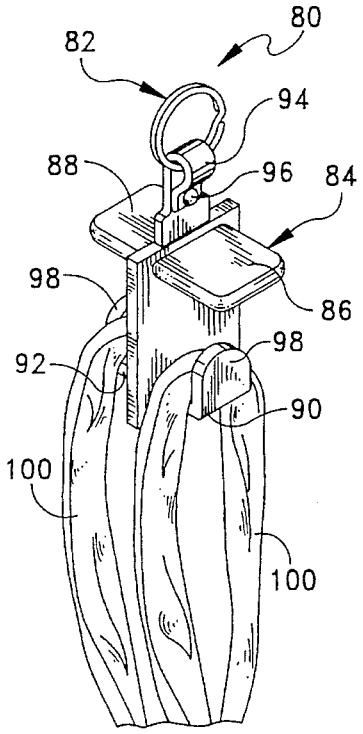
FIG. 10 is a front perspective view of the carrying device illustrated in FIGS. 8 and 9, the carrying device supporting a bag having a pair of handles.

Referring now to the carrying device generally indicated at 80 in FIGS. 8–10, it comprises a top attaching element, generally indicated at 82, embodying a key ring of conventional construction, and a bottom element, generally indicated at 84. The bottom element 84 of carrying device 80 includes a vertically disposed wall or body portion 85, carrying means having a pair of oppositely extending carrying portions 86, 88 which extend outwardly in opposite directions from wall 85 and function identically as carrying portions 50, 52 of carrying device 40, and a pair of oppositely extending hooks 90, 92 which also extend outwardly in opposite directions from wall 85. As shown, the bottom element 84 having wall 85, carrying portions 86, 88 and hooks 90, 92 is integrally formed as one-piece from molded plastic and is attached to the key ring by a flexible piece 94 which is looped around the key ring and secured thereto by rivet 96. Each hook 90, 92 of the bottom element 84 has an upwardly formed end 98 which is especially suited for supporting and retaining articles. As illustrated in FIG. 9, the hooks 90, 92 can support hangers 22. The hooks 90, 92 of carrying device 80 can also support bags having handles 100 as illustrated in FIG. 10.

The carrying device 80 of FIGS. 8–10 is especially suited for attachment to a person's key chain so that when it is required to carry clothes hangers or bags with handles, the person may easily access the device 80 so that the items can be comfortably carried without exerting excess pressure on the person's hands. The carrying device 80 may further include a bottom support ring suitably mounted on the bottom element 84 for enabling the user of the device to carry additional articles, or attach additional keys to it.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A carrying device for carrying articles on hangers, said carrying device comprising:

a top attaching element having a key ring and a flexible piece attached to the key ring;

a body portion having a top end portion secured to the flexible piece;

carrying means having a pair of oppositely extending carrying portions which are attached to and extend from the body portion, said carrying portions enabling a person to carry the device between their fingers; and hook means having a pair of oppositely extending hooks which are attached to and extend from the body portion below said carrying portions, said hooks enabling a person to hang and support articles therefrom.

2. A carrying device as set forth in claim 1, said top attaching element, carrying means and hook means being integrally formed as one unit and rigid with respect to one another.

3. A carrying device as set forth in claim 2, said carrying means further comprising pads mounted on said carrying portions for cushioning purposes when carrying said device.

4. A carrying device as set forth in claim 1 further comprising a second key ring fixedly secured to a bottom end portion of the body portion.

5. A carrying device as set forth in claim 1 fabricated from molded plastic.

* * * * *